US005303573A

United States Patent [19]

Douglas

[11] Patent Number: 5,303,573

[45] Date of Patent: Apr. 19, 1994

[54] WHEEL STRAIGHTENING METHOD AND APPARATUS

[75] Inventor: Thomas E. Douglas, Suwanee, Ga.

[73] Assignee: Wheel Wizard International, Inc., Chamblee, Ga.

[21] Appl. No.: 888,871

[22] Filed: May 26, 1992

[51] Int. Cl.[5] ..... B21D 3/14; B21D 37/00; B21J 13/04; B21J 13/10

[52] U.S. Cl. ..... 72/420; 72/455; 72/466; 72/479; 72/701; 269/69; 269/71

[58] Field of Search ..... 72/293, 311, 316, 420, 72/455, 466, 479, 701; 269/67, 69, 70, 71

[56] References Cited

U.S. PATENT DOCUMENTS

| | | | |
|---|---|---|---|
| 716,788 | 12/1902 | Thomson | 269/71 |
| 1,580,924 | 4/1926 | Shannon | 269/71 |
| 1,786,847 | 12/1930 | Hunt | 72/420 |
| 2,244,927 | 6/1941 | Vanstone et al. | 72/316 |
| 2,282,118 | 5/1942 | Daniel | 72/420 |
| 2,489,815 | 11/1949 | Rader | 72/420 |
| 2,803,064 | 8/1957 | Eisele | 269/69 |
| 4,145,006 | 3/1979 | Webb | 269/69 |
| 4,363,475 | 12/1982 | McCarty | 269/69 |

FOREIGN PATENT DOCUMENTS

| | | | |
|---|---|---|---|
| 3-151121 | 6/1991 | Japan | 72/420 |
| 153891 | 7/1931 | Switzerland | 269/71 |

*Primary Examiner*—Lowell A. Larson
*Assistant Examiner*—Donald M. Gurley
*Attorney, Agent, or Firm*—James B. Middleton

[57] ABSTRACT

Aluminum automobile wheels are straightened by exerting gentle pressure on the wheel to urge the wheel back to its original shape. If the metal does not move under pressure, the wheel is heated, and pressure again exerted, the process continuing until the wheel becomes round. A C-shaped wheel mount carries a spindle which mounts a hub. The hub rigidly receives the wheel, and the hub is selectively rotatable, and the wheel mount is selectively rotatable about a horizontal axis. The wheel is gently brought back to shape without excess heat or excess working to damage the metal. A final metal spinning step relieves stresses in the metal and brings the wheel to final tolerances.

8 Claims, 2 Drawing Sheets

WHEEL STRAIGHTENING METHOD AND APPARATUS

FIELD OF THE INVENTION

This invention relates generally to automobile wheel straightening, and is more particularly concerned with a method and apparatus for reconditioning aluminum automobile wheels.

BACKGROUND OF THE INVENTION

Many automobiles currently have special wheels to improve the appearance of the automobile, and the special wheels are usually considerably more expensive than the standard wheels provided by the automobile factory. Wheels are of course quite subject to damage. It will be easily understood that, when an automobile is involved in a wreck, the wheels are very likely to be bent and generally misshapen; however, a wheel can also be bent out of its proper shape by engagement with curbings, ruts in the road and the like, especially if engaged at high speed.

It is well known that metal is malleable, or can be made so with sufficient heat. If enough heat is added, the metal becomes quite plastic and can be easily worked into any shape desired. It will be understood, however, that a load bearing member such as an automobile wheel comprises a particular alloy to carry the designed load, and the alloy is heat treated both to remove stresses and to provide the strength required. As a result, it should be understood that uncontrolled heating of the metal and careless working of the metal can in fact destroy the wheel for its intended purpose.

In view of the difficulty in straightening wheels without damaging the strength of the wheel, many wheels are simply discarded and replaced rather than being straightened and reused.

SUMMARY OF THE INVENTION

The present invention provides a method and apparatus for straightening aluminum automobile wheels, the method including the steps of mounting the wheel and providing for selective rotation of the wheel for access required. The wheel is checked for lack of roundness, and the various portions of the wheel are gently urged back into the original shape. The metal of the wheel is substantially steadily pulled and pushed into shape rather than being hammered, and the temperature of the wheel is gradually increased just until the metal of the wheel begins to move. Thus, no more heat than absolutely necessary is added to the wheel in order to effect the straightening.

The apparatus of the present invention includes a rotatable mounting means having a spindle for receiving the wheel, the spindle being selectively lockable and rotatable. Also, the wheel mounting means is mounted on a horizontal axis, and the entire mounting means is selectively rotatable about the horizontal axis. Various special tools are utilized to apply substantially steady pressure to various parts of the wheel to urge the wheel back into shape, and a resilient pad is utilized between the tool and the wheel to prevent the tools from marring the wheel.

Thus, the present invention provides a method and apparatus for straightening an aluminum automobile wheel by gently urging the wheel back to its original shape, with some heat added as required. Since the mounted wheel can be rotated, a worker has access to all portions of the wheel. A final step of utilizing a metal spinning technique allows very close tolerances to be reached, and assures the reduction of internal stresses within the metal.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE PREFERRED EMBODIMENT

Figure 1:
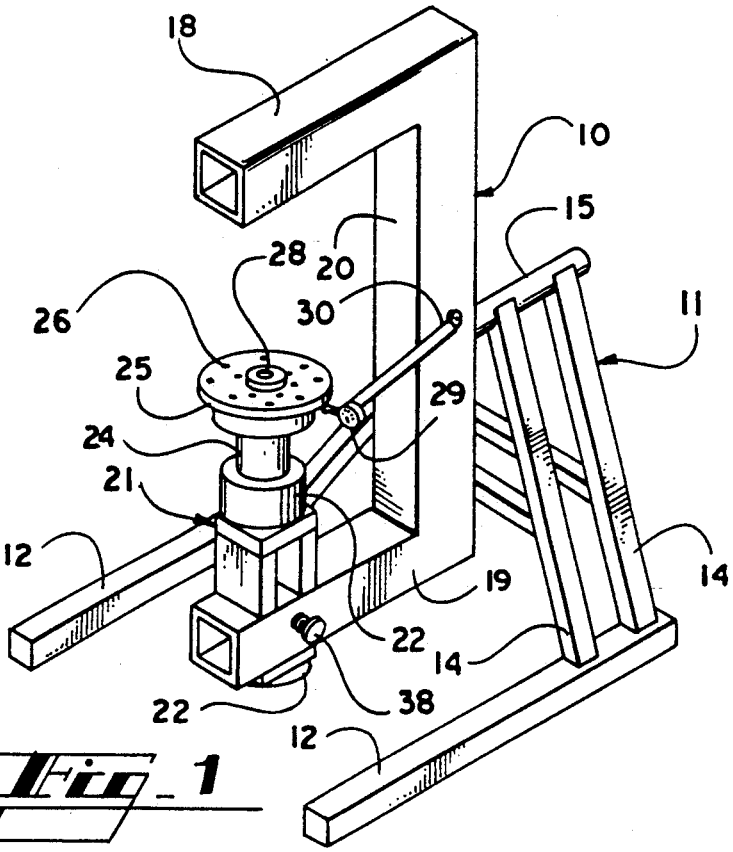
FIG. 1 is a perspective view showing a wheel mounting device made in accordance with the present invention.
Figure 2:
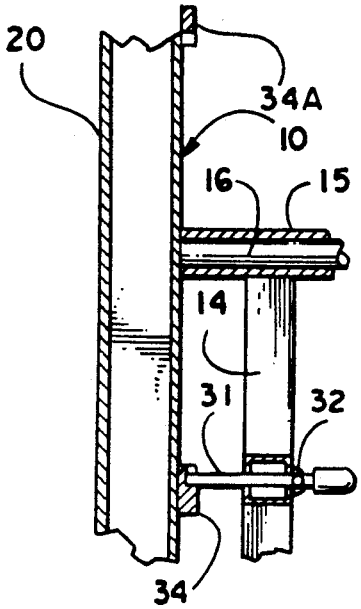
FIG. 2 is a fragmentary cross-sectional view showing the horizontal axis for mounting the support means.

Referring now more particularly to the drawings, and to that embodiment of the invention here presented by way of illustration, FIG. 1 of the drawings shows a wheel mounting device including a C-shaped support 10 rotatably mounted on a base 11. The base 11 includes a pair of runners 12, and a pair of A-frames 14 carrying a bearing 15 at their apex. As can be seen in FIG. 2, the bearing 15 receives the axle 16 which is fixed to the wheel support 10. The wheel support 10 is therefore rotatable about a horizontal axis.

The wheel support 10 has upper and lower arms 18 and 19 connected by the vertical member 20. Since the support 10 is rotatable, it will be understood that either of the arms 18 or 19 may be upper or lower at any given time; however, as here used, the lower arm 19 is the arm that receives the wheel spindle 21. This terminology will be utilized regardless of the actual position of the wheel support 10.

The wheel-support 21 includes a pair of bearings 22 carrying an axle 24; and, received on the axle 24 is a hub 25 having a plurality of holes 26 therein. Centrally of the hub 25 is an alignment ring 28. The holes 26 are threaded, and include a plurality of hole patterns, the arrangement being such that virtually any automobile wheel can be appropriately fixed to the hub 25 by means of the normal lugs. The hub 25 is of course easily removable so that a different hub can be used, for an even greater variety of bolt patterns. A screw passes through the center of the hub and into the axle 24. The alignment ring 28 will match the wheel hub size and provide for precise alignment of the wheel with the center of the axle 24.

Adjacent to the hub 25 there is a gauge 29 carried by an arm 30. The arm 30 and gauge 29 are preferably mounted on universal joints so the gauge 29 can be moved and oriented as desired. The gauge 29 is an accurate gauge, preferably being calibrated in at least thousandths of an inch, or hundredths of a millimeter.

Attention is again directed to FIG. 2 of the drawings which illustrates the latching means for selectively preventing rotation of the wheel support 10. In FIG. 2 it will be seen that there is a latch pin 31 carried by the A-frame 14 and pivoted at 32. The extending end of the latch pin 31 is received in a latch member 34 which is fixed to the vertical member 20 of the wheel support 10. Thus, the latch pin 31 can be rotated about the pivot 32 to remove the latch pin 31 from the latch member 34, thereby allowing the wheel support 10 to rotate. When the member 20 has rotated 180 degrees, it will be seen that there is another latch plate designated at 34A which will be engaged by the latch pin 31. The wheel support 10 is therefore freely rotatable through 360 degrees, and is lockable in position at either 0° or 180°.

Figure 3:
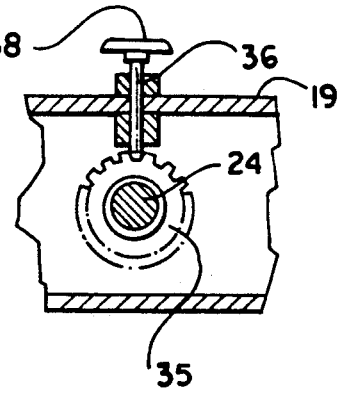
FIG. 3 is a detailed, fragmentary view showing the means for selective rotation of the wheel spindle.

A wheel mounted on the hub 25 needs to be rotatable about the axle 24 so a worker can reach any portion of the wheel. To allow selective rotation of the wheel, there is a locking arrangement shown in FIG. 3 of the drawings. It will be seen that the shaft 24 extends into the lower arm 19, and has a gear 35 fixed thereto. A pin 36 is selectively receivable between the teeth of the gear 35 to hold the gear 35, hence the shaft 24, in a selected position. By pulling out on the handle 38, the pin 36 can be removed from between the teeth on the gear 35, allowing the shaft 24 to rotate freely. When the shaft is in the desired position, the handle 38 can be urged inwardly so the pin 36 will again be positioned between the teeth of the gear 35 to lock the shaft 24 in position. A set screw may of course be provided to prevent inadvertent movement of the handle 38.

Figure 4:
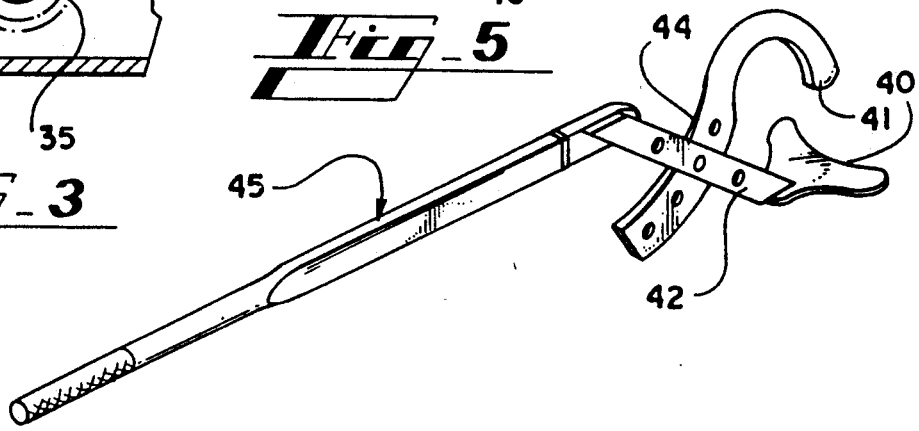
FIG. 4 is a perspective view showing a pulling tool made in accordance with the present invention.

FIG. 4 of the drawing shows one of the tools for causing movement of the metal of wheels, this particular tool being designed to pull, or to exert a radially outward force on the rim of a wheel. The tool includes a fulcrum member 40 that will rest on the central portion of a wheel, and a pulling member 41 in the form of a hook to engage the periphery of the wheel.

The fulcrum member 40 is carried at the end of a shaft 42, and the pulling member 41 is carried by a shank 44 which is pivoted to the shaft 42. The shaft 42 is, then, fixed to the end of a torque wrench 45. With this arrangement, it will be understood that the torque wrench 45 can be preset to the torque desired; and, when the set torque is reached a ratchet in the wrench will cause slippage, so no further force will be applied to the pulling member 41.

Figure 5:
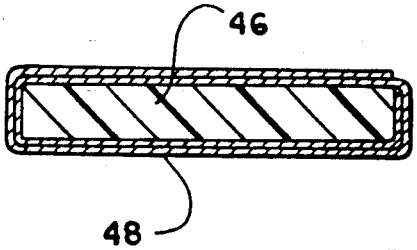
FIG. 5 is an enlarged, transverse cross-sectional view through a protective pad for use in the present invention.

Since the pulling member 41 is necessarily a relatively hard metal, it will be recognized that it may cause damage to the surface of a wheel. To prevent such damage, a protective pad is placed between the hook and the wheel. The pad is shown in FIG. 5 of the drawings and includes a core 46 of a silicone rubber, covered by one or more windings of sheet copper 48. The sheet copper is of a thickness that would be referred to as copper foil, perhaps around 36 gauge AWG.

The silicone rubber has the strength to withstand the forces involved, and can also withstand the greatest heat used. The copper winding prevents the rubber from sticking to the aluminum wheel, or discoloring the metal due to chemical reaction, while being sufficiently malleable to conform to the wheel and the tool to prevent mechanical damage.

Figure 6:
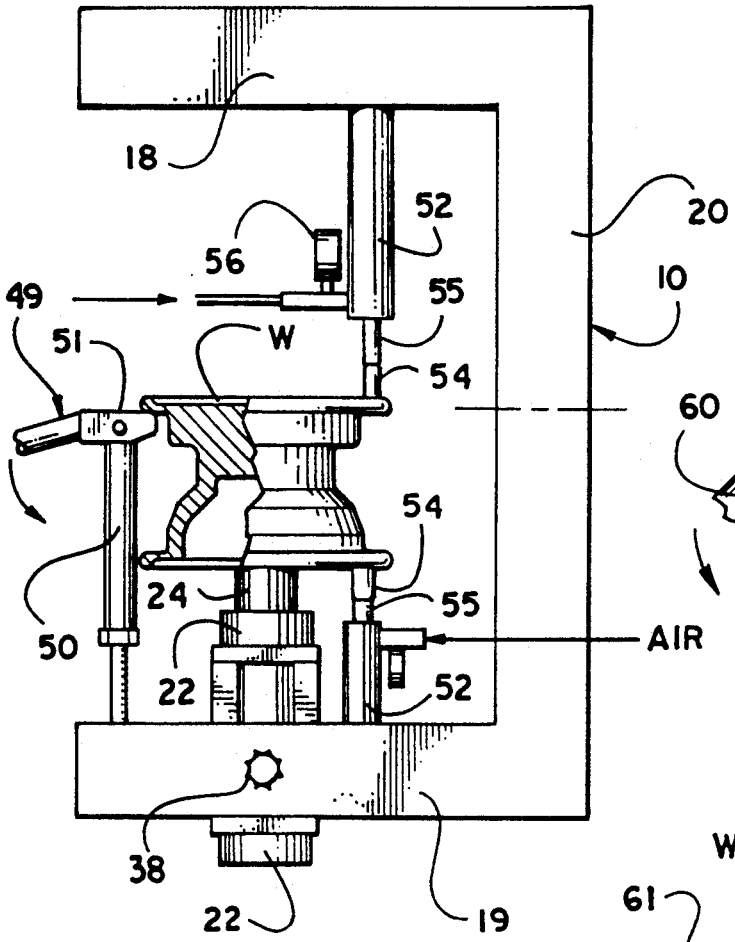
FIG. 6 is a side elevational view showing the wheel mounting device, and illustrating additional tools for straightening the wheel.

FIG. 6 illustrates several tool usages for straightening a wheel in accordance with the present invention. The wheel W is mounted in the mounting device 10 as previously described, and is well fixed in place.

On the left side of the drawing there is a lifting tool 49 which includes a vertically adjustable post 50, and a pivoted arm 51. The fulcrum is very close to the load receiving tip, so great force can be exerted on the wheel when required. The vertical adjustment allows variation for different wheels. Remembering the above discussion, it will be realized that the tool 49 can be used on the lower rim by inverting the device 10, and using the tool 49 as shown.

FIG. 6 also shows two pushing tools, which are substantially the same, but are of different lengths. The pushing tools 52 comprise fluid operated jacks having a wheel engaging member 54 fixed to the cylinder rod 55. A gauge 56 allows the pressure to be monitored during use of the tool. Both the pushing tools are made alike, and are used alike, so the same reference numerals are applied to both tools. Furthermore, it will be understood that a tool 52 can be used radially of the wheel, acting between the vertical member 20 and a radius of the wheel W.

Figure 7:
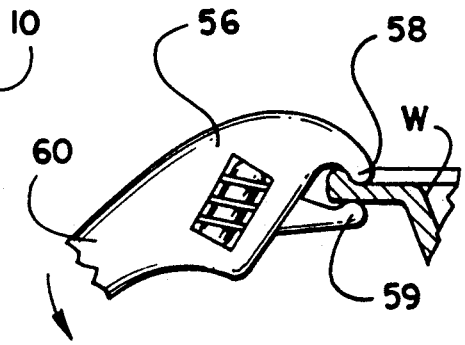
FIG. 7 is a fragmentary view showing a tool for bending the rim of a wheel.

When a small part of the rim of a wheel needs to be straightened, or reshaped, the tool 56 shown in FIG. 7 can be used. The tool 56 has opposed jaws and 58 and 59 to engage the rim. Motion of the extending handle 60, which is broken away for convenience, will reshape the rim. As here shown, the jaw 59 is movable to adjust the tool for use on thick and thin rims.

Those skilled in the art are aware that metal is sometimes shaped by spinning the metal, while urging a shaping tool against the metal. This spinning technique may be utilized in the present invention to bring the wheel closer to tolerances, and to relieve stresses to allow final straightening by the above described techniques. The wheel W is mounted for rotation, for example on a lathe. The head of the lathe will rotate the wheel, and the standard tool holder of the lathe carries a roller 61. The roller 61 is urged against the wheel W as the wheel turns. The lathe is of course capable of precision placement of the roller 61, so the wheel can be rolled, or spun, to work the metal and approach the desired dimensions.

Figure 9:
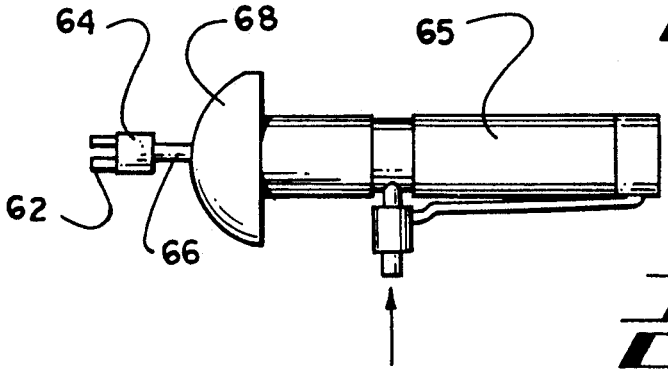

With the foregoing description in mind, the method of the present invention should be understandable. A wheel is first cleaned, and all accessories are removed. Balancing weights can be removed by the conventional tool. The valve stem can be removed by the tool shown in FIG. 9 of the drawings. A split cylinder 62 can engage the threads of the valve stem, and the keeper 64 will be moved down to secure the cylinder 62. Fluid pressure is then admitted to the cylinder 65, and the rod 66 will be drawn inwardly. The wheel bearing member 68 is of a hard rubber or other non-marring material. Once the rod 66 is retracted to the point that the bearing member 68 is against the wheel, further motion will extract the valve stem.

Next, the wheel W is mounted on the hub 25 using the appropriate hole pattern so conventional lugs will secure the wheel W. The operator then examines the wheel to determine what motions of the wheel will restore the wheel, and whether pushing or pulling is requred. The appropriate tool will be chosen, and the force will be exerted. Generally, the metal will not move at ambient temperature, so some heat is added, using a torch, such as an oxy-acetylene or propane torch. The heat is added slowly, and the temperature of the metal is increased slightly, then force is exerted. If the metal does not move, more heat is added to further increase the temperature slightly. This process is continued until the metal moves, and the wheel begins to resume its proper shape.

The amount of heat put into the wheel is preferably monitored. One simple way to do this is to utilize a flow meter to indicate the rate of flow of gas to the torch flame, and to time the heating. By standardizing the rate at which fuel is comsumed, one can judge the amount of heat by the length of time the torch is applied.

It has been found that, if there is a large indentation at one point in the rim of a wheel, there will be some smaller protuberances elsewhere on the rim. The process is to work on the worst first, so the dent will be pulled out. When the dent is partly removed, some pressure may be used to urge the protuberances back into shape. As the shape approaches round, the pin 36 can be pulled to allow the wheel to rotate, and deviations from round can be checked with the gauge 29.

While one avoids any significant hammering on the wheel, it has been found that good results are obtained when using the tool shown in FIG. 4. With the wheel heated and force being exerted by the pulling member 41, when the torque wrench reaches its set limit, the snap action has a hammering effect to produce stable movement, limiting some of the spring-back effect.

Some wheels may be damaged to the point that the metal is fractured. Any fracture must be welded together and the weld dressed properly. only after completing the weld will the process of straightening the wheel begin.

Figure 8:
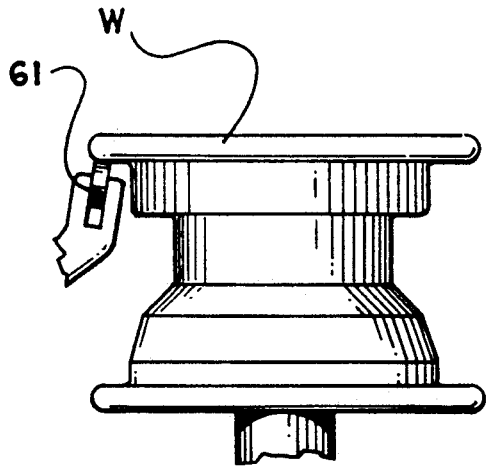
FIG. 8 is a side elevational view illustrating the metal spinning technique used on the wheels in accordance with the method of the present invention; and, FIG. 9 is a side elevational view of a tool for removing the valve stems from wheels.

As was mentioned previously, if the wheel does not move into the tolerances using the above described techniques, the wheel can be subjected to the rolling, or spinning technique illustrated in FIG. 8. The wheel will then be brought into tolerances by the previously described techniques.

As a final step, the wheel will be refinished.

It will be understood that, in working with metal, and heating the metal, it may sometimes be desirable to allow the wheel to sit alone so the internal stresses are relieved before further working of the wheel. The presence of stresses can be detected, or assumed, when reasonable force does not cause the expected movement of the metal. When this occurs, the heated wheel is preferably allowed to sit for several hours, then the process of heating and stressing is repeated.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. Wheel straightening apparatus, for straightening aluminum automobile wheels, said apparatus comprising wheel mounting means having a horizontal axle, said wheel mounting means being generally C-shaped and including an upper arm and a lower arm extending horizontally, a wheel support carried by said lower arm and including a vertical axle extending perpendicularly to said lower arm, a hub selectively fixable to said vertical axle for receiving the wheel to be straightened, and fastening means to fix said wheel to said hub, bearing means for receiving said horizontal axle, and a base for supporting said bearing means, gauge means carried by said wheel mounting means and disposable adjacent to said hub, said mounting means further including means for selectively locking said vertical axle against rotation, a latch pin mounted on said base, a latch plate on said wheel mounting device for cooperation with said latch pin for selectively preventing rotation of said wheel mounting means about said horizontal axle, and a plurality of tools for exerting forces on a wheel to be straightened mounted on said hub.

2. Wheel straightening apparatus as claimed in claim 1, said wheel support including a pair of bearings carried by said lower arm and receiving said axle therethrough, said means for selectively locking said spindle against rotation including a gear fixed to said axle, and pin means selectively engageable with said gear.

3. Wheel straightening apparatus as claimed in claim 1, and further including a protective pad received between a tool of said plurality of tools and said wheel to be straightened.

4. Wheel straightening apparatus as claimed in claim 3, said protective pad comprising an elastomeric core, and a metal wrapping covering said core.

5. Wheel straightening apparatus as claimed in claim 4, said elastomeric core consisting of silicone rubber.

6. Wheel straightening apparatus as claimed in claim 5, said metal wrapping consisting of copper sheet.

7. Wheel straightening apparatus as claimed in claim 1, said aluminum wheels including a center portion and a rim concentric with said center portion, one tool of said plurality of tools including a fulcrum member for engaging said center portion of a wheel to be straightened, a pulling member pivoted with respect to said fulcrum member, said pulling member including a hook for engaging said rim of the wheel to be straightened, and a handle for placing a rotational force on said pulling member with respect to said fulcrum member so that said rim is moved relative to said center portion.

8. Wheel straightening apparatus as claimed in claim 1, one tool of said plurality of tools including a jack, said jack including a fluid operated cylinder engageable with said mounting means, a cylinder rod engageable with the wheel to be straightened, and a source of fluid under pressure for causing said cylinder rod to exert a force against the wheel to be straightened.

* * * * *